US006102813A

United States Patent [19]

Dill

[11] Patent Number: 6,102,813

[45] Date of Patent: Aug. 15, 2000

[54] GOLF CLUB WITH A HOSEL TRAVERSING THE HEAD

[76] Inventor: Terry Dill, 9 Swift Water Trail, Austin, Tex. 78738

[21] Appl. No.: 09/199,605

[22] Filed: Nov. 25, 1998

[51] Int. Cl.[7] ..... A63B 53/02

[52] U.S. Cl. ..... 473/305; 473/344; 473/335

[58] Field of Search ..... 473/305, 311, 473/324, 338, 344, 329, 342, 334, 335, 349

[56] References Cited

U.S. PATENT DOCUMENTS

| | | | |
|---|---|---|---|
| 1,249,127 | 12/1917 | Lard | 473/311 |
| 1,913,821 | 6/1933 | Stumpf | 473/335 |
| 2,004,968 | 6/1935 | Young . | |
| 2,960,338 | 11/1960 | Havey et al. . | |
| 3,692,306 | 9/1972 | Glover . | |
| 3,819,181 | 6/1974 | Mills | 473/311 |
| 4,432,550 | 2/1984 | Byars . | |
| 4,681,322 | 7/1987 | Straza et al. | 473/342 |
| 5,024,437 | 6/1991 | Anderson . | |
| 5,094,383 | 3/1992 | Anderson et al. . | |
| 5,193,811 | 3/1993 | Okumoto et al. . | |
| 5,251,901 | 10/1993 | Solheim et al. . | |
| 5,255,918 | 10/1993 | Anderson et al. . | |
| 5,261,663 | 11/1993 | Anderson . | |
| 5,261,664 | 11/1993 | Anderson . | |
| 5,273,283 | 12/1993 | Bowland . | |
| 5,344,140 | 9/1994 | Anderson . | |
| 5,417,419 | 5/1995 | Anderson et al. . | |
| 5,429,357 | 7/1995 | Kobayashi | 473/311 |
| 5,501,459 | 3/1996 | Endo . | |
| 5,518,243 | 5/1996 | Redman . | |
| 5,720,673 | 2/1998 | Anderson . | |
| 5,720,674 | 2/1998 | Galy . | |
| 5,776,011 | 7/1998 | Su et al. . | |
| 5,931,742 | 8/1999 | Nishimura et al. | 473/305 |

*Primary Examiner*—Kien T. Nguyen
*Attorney, Agent, or Firm*—Elizabeth R. Hall

[57] ABSTRACT

A golf club having a hosel that is permanently connected to a sole plate, traverses the club head, and is attached to the shaft. The sole plate is attaches to the bottom of the club head and a replaceable striking surface attaches to the front of the club head.

20 Claims, 4 Drawing Sheets

GOLF CLUB WITH A HOSEL TRAVERSING THE HEAD

FIELD OF THE INVENTION

The present invention relates to golf clubs, and in particular, to a golf club having a hosel that traverses a club head. More specifically, the present invention relates to a composite club head made of metal and wood having a hosel with one end attached to a sole plate, the body of the hosel traversing the club head, and the other end connected to a shaft.

BACKGROUND OF THE INVENTION

In the past, golf club heads were made of wood, typically either persimmon wood or other high quality hard woods either in solid or laminated form, which was cut and sanded into the desired shape. Subsequently, golfers wanted more control of the shape and weight distribution of the club, so manufacturers began to make clubs heads out of metal, such as stainless steel or titanium. Metal clubs, however, are not as aesthetically pleasing as their wood counterparts and produce an artificial or tinny sound when impacted upon a golf ball.

Further, in a conventional wood-type golf club, the shaft is connected to the wooden head of the club by being secured in a bore near the rear or heel portion of the head. The center of gravity of the club head and the ball-striking surface of the club head are out of alignment with the shaft. This produces a twisting action or torque on the shaft both during the swinging of the club and as a result of impact with the golf ball. Typically, the shaft-receiving bore or hosel in a conventional wooden head golf club is surrounded by a relatively thin sheath of wood that must hold the head securely onto the shaft. The severe strains encountered in swinging the club and hitting a golf ball frequently causes this thin wooden sheath to split or crack.

Golfers, in an attempt to specifically control the weight of the golf club, have individually weighted a club head according to the specific characteristics of the golfer using the club. Adding weight to the club head changes the flex of the shaft, the kick point of the swing, and the swing weight of the club. Golfers have typically adjusted the weight of the club head by adding weight to the outside surface of the club head or using awkward, multi-part weight distribution methods such as described in U.S. Pat. Nos. 5,776,011, 5,720,674 and 3,692,306.

SUMMARY OF THE INVENTION

The invention contemplates a golf club having a hosel attached to a bottom plate at one end, traversing the club head, and connected to a shaft at the other end.

One embodiment of the present invention is a golf club comprising a sole plate and a hosel that traverses the club head body where one end of the hosel is attached to the sole plate and the other end is attached to a shaft a short distance above the top of the club head body.

Another embodiment of the present invention is a golf club having a unitary metal cradle having a sole plate, a hosel and a face plate. The cradle is attached to the club head body with the hosel traversing a borehole in the club head body and attached to a shaft where the hosel extends beyond the top surface of the club head body.

The foregoing has outlined rather broadly several aspects of the present invention in order that the detailed description of the invention that follows may be better understood.

Additional features and advantages will be described which form the subject of the claims.

BRIEF DESCRIPTION OF THE DRAWINGS

The accompanying drawings, which are incorporated in and form a part of the specification, illustrate the embodiments of the present invention, and with the description, serve to explain the principles of the invention. In the drawings.

It is to be noted that the drawings illustrate only typical embodiments of the invention and are therefore not to be considered limiting of its scope, for the invention will admit to other equally effective embodiments.

DETAILED DESCRIPTION OF THE INVENTION

Figure 1:
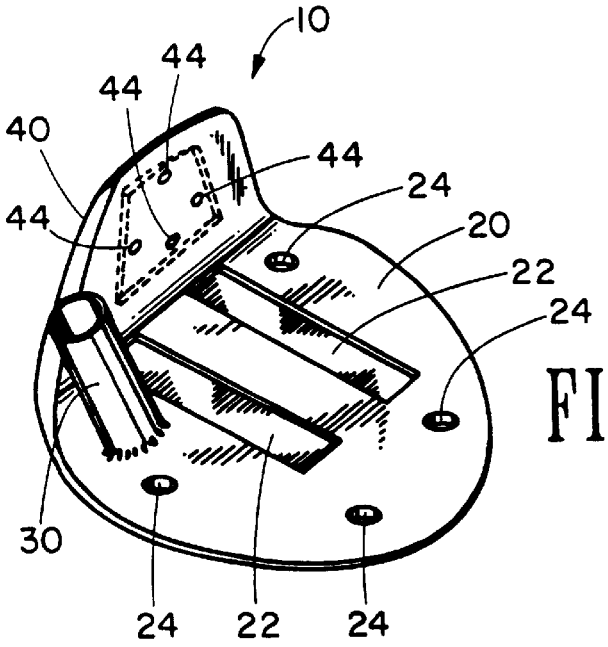
FIG. 1 is a perspective view of a cradle of the present invention showing a sole plate, a hosel, and a face plate.
Figure 2:
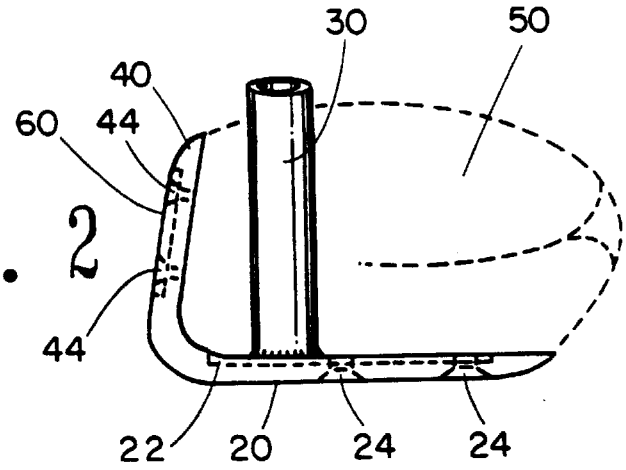
FIG. 2 is a side view of a cradle whose face plate includes an inlaid strike plate.
Figure 4:
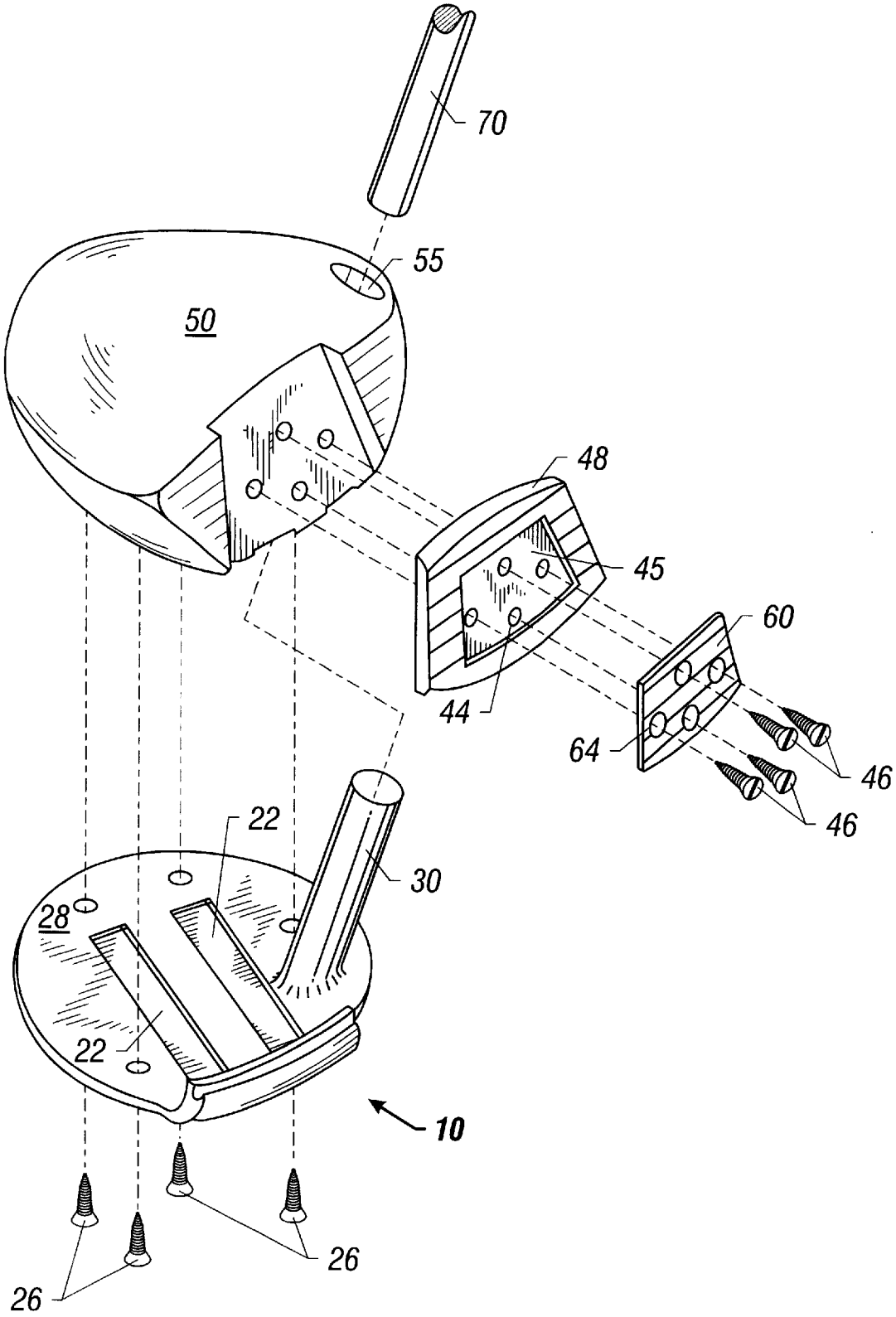
FIG. 4 is an exploded perspective view of a golf club of the present invention showing a cradle, a face plate, a strike plate and a club head.

The present invention relates to golf clubs having a hosel that traverses a golf club head. FIGS. 1 and 2 illustrate one embodiment of the present invention. FIGS. 1 and 2 illustrate a cradle 10 comprising a bottom portion or sole plate 20, an upright portion or face plate 40 and a shaft-receiving bore or hosel 30. The hosel 30 is the part of the club that connects the club head to the golf shaft 70 as shown in FIG. 4. The hosel 30 of the present invention is made of metal, traverses the body 50 of the club head, and is attached to the sole plate 20.

In contrast, a conventional golf club has an enlarged club head formed of wood with a sole plate attached to the bottom portion of the club head with a plurality of screws. The club head also includes a wooden neck or hosel that receives and is attached to one end of an elongated shaft. A grip is mounted on the other end of the shaft so that the club head may be swung in an arc to contact a golf ball resting on a tee or on the ground.

The present invention eliminates the wood hosel of traditional golf clubs, replacing it with a metal hosel instead. Thus the strain of impact where the club head is joined to the shaft is transferred to a metal hosel rather than a wood hosel. By transferring the strain of impact to a metal hosel, the golf club of this invention virtually eliminates splitting or cracking of the hosel due to physical strain.

Figure 3:
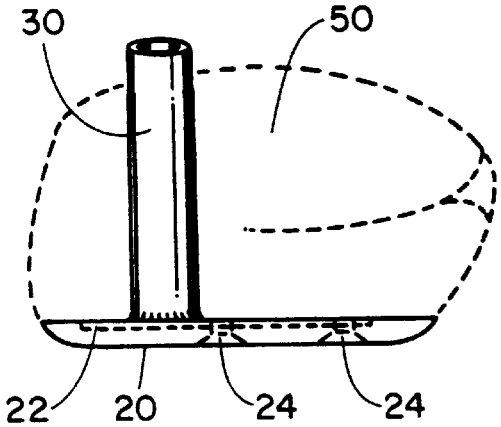
FIG. 3 is a side view of a cradle without a face plate.

Cradle 10, as shown in FIG. 1, includes the sole plate 20, hosel 30, and face plate 40 integrally formed with each other by casting, stamping, or forging a metal, such as steel, aluminum alloy, or titanium, or a composite material such as graphite, carbon graphite or kevlar. Such a unitary cradle 10 can engage the respective sole, internal bore, and face surfaces of a club head body 50. Alternatively, the sole plate 20, hosel 30, and face plate 40 may be separate pieces attached together by welding, epoxying, screwing, or other conventional methods, to form the cradle 10. This could also allow the golf club designer to eliminate one or more ofthe pieces when constructing the club. For example, FIG. 3 provides a side view of another embodiment of a cradle 10 of the present invention. The cradle 10 of FIG. 3 has a sole plate 20 and a hosel 30 but no face plate 40. The face of the club head body 50 serves as the point of contact for the golf ball.

The upper surface of the sole plate 20 has one or more cavities or slots 22 running roughly parallel to each other and substantially perpendicular to the face plate 40 toward the back of cradle 10. A preferred embodiment of the golf club will have two cavities or slots 22 as shown in FIG. 1. The slots 22 are provided so that a golfer may add lead tape or lead powder or other weighted materials, such as brass, tungsten, zinc, steel, or alloys thereof, to the club head. Although slots are shown, the cavities may be of any shape or design to allow for weight adjustments in the heel to toe direction as well as the fore to aft direction to precisely adjust the weight and swing characteristics of the club head. Lead tape or a set of removable weights can be provided with the club head of the present invention, with each removable weight having a different weight. It will be appreciated that the cavities may be lined with plastic, cloth, silicon, or other cushion material to reduce vibration between the weight, the club head, and the player's hands. Weight adjustment in the sole plate 20 allows the golfer to add weight to the club to achieve the desired overall weight and weight distribution. By increasing the weight or mass behind the center of percussion or the "sweet spot," that is, the spot of desired contact with the golf ball, the energy transferred to the ball upon impact is increased, thereby increasing the distance the ball travels.

The bottom portion or sole plate 20 may be shaped to facilitate the movement of the club head in grass, in sand, or in gravel and is typically made of materials that are durable and wear5 resistant. These materials include steel, aluminum alloy, or titanium, or a composite material such as graphite, carbon graphite or kevlar. The bottom portion of the cradle 10 may be secured or attached to the body 50 of the club head using screws, hex bolts, bonding agents, or any other fastener means known in the art. For example, the sole plate 20 of FIG. 1 has a plurality of countersunk holes 24, each of which receives a screw 26 that extends through the sole plate 20 and penetrates into the lower surface of the body 50 of the club head. When assembled, the sole plate 20 is substantially flush with the adjacent areas of the bottom surfaces of the body 50.

The cradle 10 also includes a shaft-receiving bore or hosel 30, which may be cast, molded, welded, glued, or integrally formed with the sole plate 20 near the heel side of the club head. The hosel 30 is made of steel, aluminum alloy, or titanium, or a composite material such as graphite, carbon graphite or kevlar and extends from about ⅛ to about ¾ inch beyond the body 50 of the club head for receiving the shaft 70 as illustrated in FIG. 4. As discussed previously, one of the advantages of using a metal hosel is that the tendency or likelihood of splitting or cracking of the hosel under varying conditions of use is substantially eliminated. Moreover, the club can be manufactured without the additional wood that is used to form the neck or hosel of a traditional golf club, thus lowering the center of weight of the club head. In traditional wood clubs, the additional wood on the club head that forms the neck or hozel contributes to about 20–35% of the weight of the club head. Thus, the elimination of this weight from the top of the club head leads to a more balanced golf club with the weight on the bottom of the club head behind the center of percussion.

FIG. 1 also shows an upright portion or face plate 40 that is roughly perpendicular to the sole plate 20. The surface of the face plate 40 includes a plurality of countersunk holes 44, each of which receives a screw 46 to secure the face plate 40 to the face of the body 50 of the club head. The face plate 40 may be integrally formed with the cradle 10, as illustrated in FIG. 2, or it may be removably connected to the sole plate 20, as shown in FIG. 4, by a variety of methods known in the art, such as welding, bonding agents, screws, ridges, or tongue and groove.

The face plate 40 may be slightly convex or bulged vertically from top to bottom and horizontally from heel to toe. When assembled, the face plate 40 is substantially flush with the adjacent areas of the face surfaces of the body 50. The face plate 40 may be positioned at any angle to provide the desired club head loft. For example, the face or face plate 40 of a driver is typically provided with an 8 to 12 degree loft, while that of a three-wood is typically provided with a 15-degree loft. With the removal of the excess wood needed for the hosel of a traditional club and/or the addition of weight to the sole plate, a lower face loft may be used, thereby providing more distance to the golf shot but without loss of trajectory. If desired, the face plate 40 of the cradle 10 can be made with a recessed or indented area 45. As discussed below, this allows a golfer to insert a strike plate 60 of any desired composition on the face of the club.

Turning now to FIG. 4, there is shown an exploded perspective view of a golf club of the present invention including a sole plate 28, hosel 30, body 50, face plate 48, strike plate 60, and shaft 70. The embodiment illustrated in FIG. 4 has the hosel 30 permanently attached to the sole plate 28, whereas the face plate 48 is made as a separate piece that attaches to the face of the body 50. The face plate 48 can be made to adjoin one edge of sole plate 28, or face plate 48 can be made to attach to the face of the body 50 unattached to the sole plate 28. It should be noted that the sequence of attachment of the pieces 28, 30, and 48 is not critical when forming the cradle 10 or when constructing the golf club. For example, the face plate 48 (when used) may be attached to the cradle 10 after the body 50 of the club head is engaged with the sole plate 28 and hosel 30.

Figure 5A:
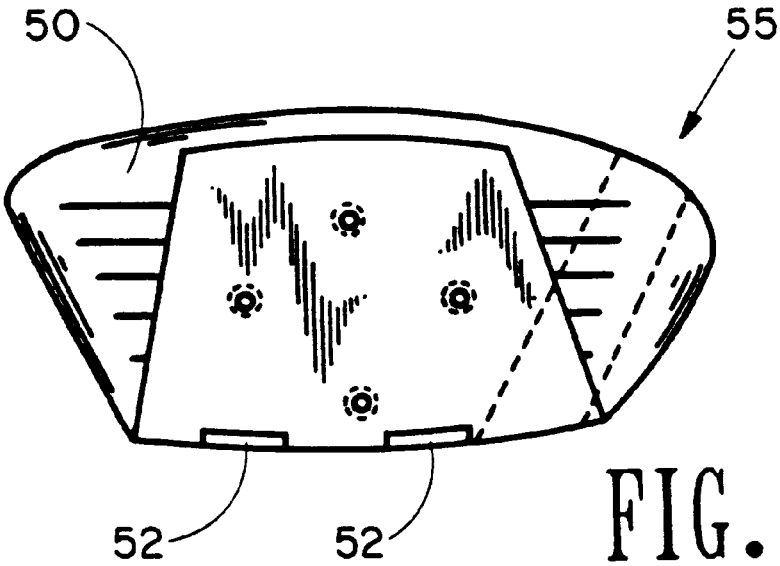
FIG. 5A is front view of a club body.
Figure 5B:
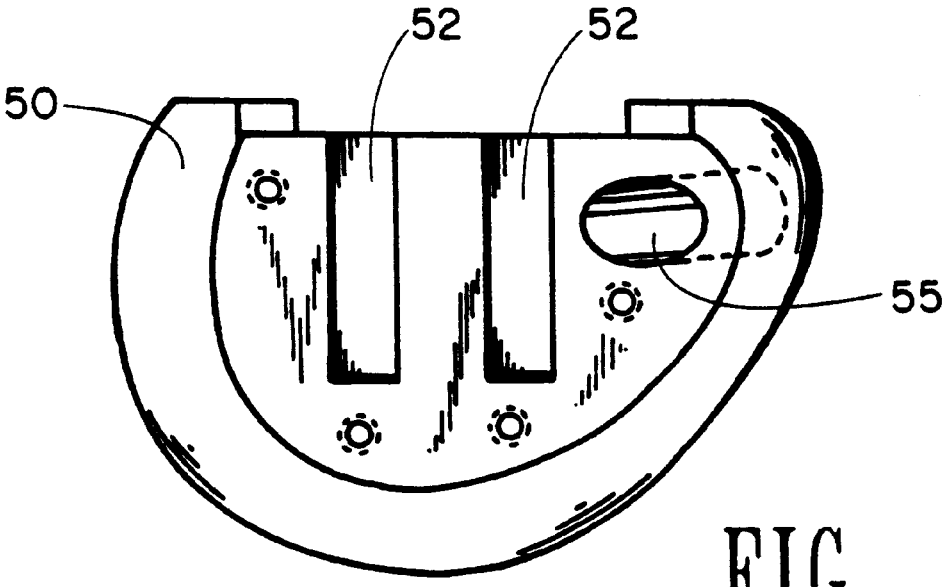
FIG. 5B is bottom view of a club body.

The body 50 of the club head is typically made of solid or hollow wood, metal, or composite materials, such as titanium, aluminum, graphite, carbon graphite, porcelain, or any other lightweight durable material. If desired, the hollow volume can be filled with a light material, such as plastic foam, capable of damping vibrations generated by impact with the ball. The golfer can select the body 50 to provide the appropriate weight distribution, stability, resonance, and mechanical inertia. In the present invention, the preferred material is solid persimmon, other high quality woods, or laminates of high quality woods. The visual and aural appearance of such wood is unmatched by so called "metal" woods. The body may be machined with ordinary tools employed for that purpose to accept the sole plate 28 and/or the face plate 48. Moreover, the body 50 has an interior cylindrical borehole 55 that runs from the bottom surface to the top surface of the body 50 for receiving the hosel 30 of the cradle 10 of the present invention. The cylindrical borehole 55 can be formed or drilled through the body 50 using conventional tools Although not required, the cradle 10, consisting of the sole plate 28 and the hosel 30, with or without the face plate 48, is of a lesser width than the distance between the heel and the toe of the body 50, with the sole and face surfaces of the body 50 being suitably machined or recessed to accommodate the sole plate 28 and the face plate 48. In general, the club head may be constructed by aligning the body 50 with the sole plate 28 and hosel 30 so that the hosel 30 penetrates or slides through the borehole 55. When so done, the bottom surface of the body 50 (illustrated in FIG. 5B) seats against the upper surface of the sole plate 28 such that the slots 22 and 52 align. The face plate 48 is added to the face of the club head and to the sole plate 28 to complete the cradle 10.

The surface of the face of the body 50 and the face plate 48 have a plurality of horizontal score lines that provide friction between the ball and the face, thereby increasing the spin on the ball to enable the ball to perform better aerodynamically. The score lines may be V-shaped grooves, square grooves, U-shaped grooves, or other shaped grooves known in the art.

If desired, the face plate 48 may be formed with a machined recess or indented area 45 in the face plate 48. A golfer may insert a strike plate 60 of any desired composition on the face of the club, for example, hard metal or ceramic inserts such as stainless steel, titanium, or depleted uranium may be used. A set of removable strike plates 60 can be provided with the club head of the present invention, with each strike plate 60 having different striking characteristics.

The strike plate 60 can be removably attached by screws, magnets, hex bolts, adhesives, rivets, or by any other known means of attachment. For example, FIG. 4 shows a plurality of screws 46 that extend simultaneously through the holes 64 in the strike plate 60 and the holes 44 of the face plate 48 and penetrate into the body 50. The strike plate 60 may also have score lines as described above. When so constructed and attached, the face plate 48 and the strike plate 60 are substantially flush and give the appearance of a one-piece club face.

Figure 6A:
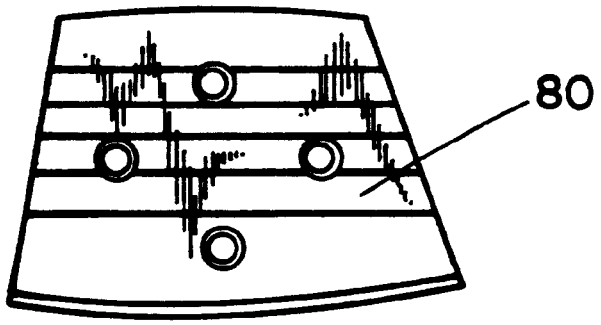
FIG. 6A is a front view of a face plate without an inlaid strike plate.
Figure 6B:
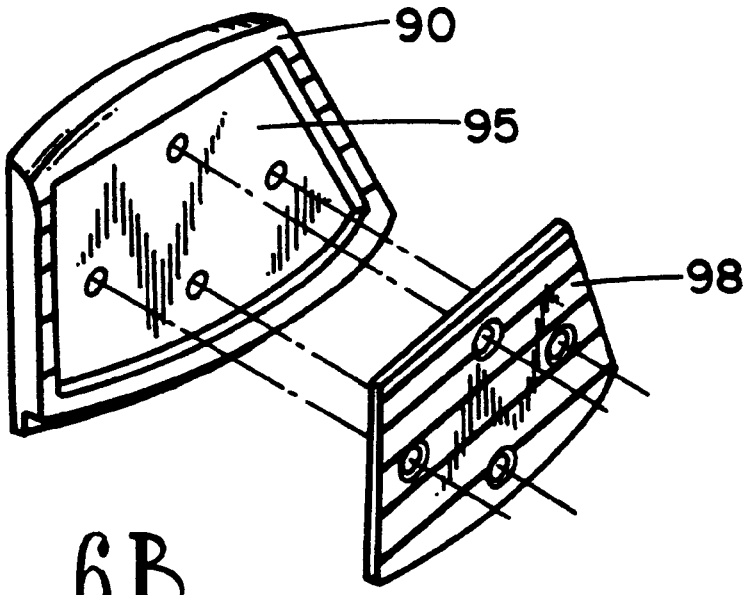
FIG. 6B is an exploded perspective view of a face plate showing a strike plate made to be inlaid into the front surface of the face plate.

The indention in the face plate may cover any percentage of the face plate surface that is desired. For example, FIG. 6B shows a face plate 90 that has an indented area 95 that covers approximately 85–95% of the surface area of face plate 90. Strike plate 98 is made to fit into the indented area 95.

Alternatively, the face plate may be one piece with no indented area for the attachment of a strike plate 60. The face plate 80 shown in FIG. 6A is such a face plate. The face plate 80 may be replaced as desired and a player may select the face plate 80 most suitable to his or her needs.

A shaft 70 is connected to the club head at the hosel 30. The preferred shaft of the present invention is from about 0.368 to about 0.370 inches in diameter. This shaft size is larger than the standard shaft size of 0.335 inches in diameter and will provide a shaft having increased strength. In addition, the size of the shaft is important in determining the stability of a golfer's swing or how much torque the golfer will encounter from the top of the swing to the bottom of the swing. Shifting the weight of the club head in the present invention diminishes the torque experienced by the golfer. Thus the diameter of the shaft where it is joined to the hosel can be increased to approximately 0.368–0.370 inches in diameter to provide the golf club with increased strength and stability.

In FIG. 4, the upper portion of the shaft 70 is broken away and omitted from the drawing. The shaft 70 and the hosel 30 are interconnected when the hosel 30 is made to fit inside the shaft 70 or when the shaft 70 is made to fit inside the hosel 30. The hosel 30 and shaft 70 may be attached by threads, a pin, adhesive, soldering, or any other means of attachment known to those skilled in 20 the art. If desired, the juncture of the hosel 30 and the shaft 70 may be sealed with an elastomeric O-ring or may be wrapped with traditional golf whipping an appropriate distance above, on top of, and below the juncture. The shaft 70 may be customized in configuration, flexibility, and length to meet a particular golfer's needs and may be made from wood, stainless steel, or reinforced composites, such as boron, graphite, carbon graphite, titanium, or aluminum. The shaft 70 usually has a conventional grip made of rubber or leather to provide a comfortable, non-slipping handle for the golfer to hold during the execution of a golf shot.

The golf club head according to the present invention promotes greater accuracy and increased distance on golf shots by concentrating more weight or mass directly behind the "sweet spot" or center of percussion. The hosel of the described club is also less likely to crack, as it is attached to the sole plate of the club head. In addition, it is believed that the removal of the excess wood needed for the hosel of a traditional club causes the center of gravity of the golf club to be lowered. The present invention also provides a method for inexpensively converting existing wood clubs into combination wood and metal clubs. For example, the ability to insert an inlaid strike plate made of titanium or depleted uranium is much less costly than the purchase of a golf club constructed entirely of these special and expensive materials.

Although the present invention and its advantages have been described in detail, it should be understood that various changes, substitutions, and alterations can be made to the described golf club without departing from the spirit and scope of the invention as defined by the appended claims.

What is claimed is:

1. A golf club comprising:

a body having a top surface, a bottom surface, a front surface and a borehole traversing the body from the bottom surface to the top surface;

a sole plate attached to the bottom surface of the body and covering substantially all of the bottom surface, said sole plate having a plurality of indentations in an inner surface of the sole plate wherein said inner surface faces the bottom surface of the body when the sole plate is attached to the bottom surface, said indentations running substantially parallel to each other and substantially perpendicular to the front surface of the body wherein said indentations substantially align with an equal number of indentations in the bottom surface of the body to form cavities between the sole plate and the body when said indentations are so aligned;

a hosel having a first end a middle and a second end, the first end attached to the sole plate, the middle traversing the borehole and the second end extending beyond the top surface of the body; and a shaft attached to the second end of the hosel.

2. The golf club of claim 1, wherein the shaft is attached to the hosel from approximately ⅛ inch to about ¾ inch above the top of the body.

3. The golf club of claim 1, wherein the diameter of the shaft where it is attached to the hosel is from about 0.368 inches to about 0.370 inches in diameter.

4. The golf club of claim 1, further comprising a face plate attached to the front surface.

5. The golf club of claim 4, wherein the face plate has an indented area on the front surface of the face plate.

6. The golf club of claim 5, wherein the indented area comprises approximately 85–95% of the surface area of the front surface of the face plate.

7. The golf club of claim 5, further comprising a detachable strike plate inlaid in the indented area and attached to the face plate.

8. A golf club comprising:

a club head body having a bottom surface, a top surface, a face surface, and a borehole traversing the body from the bottom surface to the top surface;

a unitary cradle secured to the body, the cradle comprising a sole plate and a hosel, wherein the sole plate engages the bottom surface of the body and the hosel traverses the borehole and extends beyond the top surface of the borehole;

a face plate, said face plate engaging the face surface of the body and interacting with the cradle in a reversible manner; and a shaft having a lower portion connected to the hosel.

9. The golf club of claim 8, wherein the shaft is connected to the hosel from approximately ⅛ inch to about ¾ inch above the top surface of the body.

10. The golf club of claim 8, wherein the lower portion of the shaft is from about 0.368 inches to about 0.370 inches in diameter.

11. A golf club comprising:

a club head body having a top surface, a bottom surface, a front surface and a borehole extending from the bottom surface to the top surface of the body;

a unitary metal cradle having a sole plate, a hosel and a face plate, wherein the sole plate and the face plate are attached to the bottom surface and the front surface respectively and the hosel traverses the borehole to extend beyond the top surface of the body; and a shaft attached to the hosel where the hosel extends beyond the top surface of the body.

12. The golf club of claim 11, wherein the sole plate and the bottom surface of the body have a plurality of indentations, the indentations of the sole plate substantially aligning with the indentations on the bottom surface of the body to form cavities when the cradle is attached to the body.

13. The golf club of claim 12, wherein the cavities are suitable for receiving lead tape.

14. The golf club of claim 12, wherein the indentations run substantially parallel to each other and substantially perpendicular to the face plate.

15. The golf club of claim 14, wherein the indentations are substantially rectangular.

16. The golf club of claim 14, wherein the indentations traverse at least one third of the distance from the face plate to a back side of the body.

17. The golf club of claim 11, wherein the face plate has an indented area made to receive a striking plate such that an outer surface of the striking plate fits flush with an outer surface of the face plate.

18. The golf club of claim 11, wherein the shaft is attached to the hosel from approximately ⅛ inch to about ¾ inch above the top surface of the body.

19. The golf club of claim 11, wherein the lower portion of the shaft is from about 0.368 inches to about 0.370 inches in diameter.

20. A golf club comprising:

a club head body having a top surface, a bottom surface, a front surface and a borehole extending from the bottom surface to the top surface of the body;

a unitary metal cradle having a sole plate, a hosel and a face plate, wherein the sole plate and the face plate are attached to the bottom surface and the front surface respectively and the hosel traverses the borehole to extend beyond the top surface of the body;

a plurality of indentations in the sole plate and the bottom surface of the body, said indentations of the sole plate substantially aligning with the indentations on the bottom surface of the body to form cavities when the cradle is attached to the body; and a shaft attached to the hosel approximately ⅛ to about ¾ inch above the top surface of the body.

* * * * *

UNITED STATES PATENT AND TRADEMARK OFFICE

CERTIFICATE OF CORRECTION

PATENT NO. : 6,102,813
DATED : August 15, 2000
INVENTOR(S) : Terry Dill

It is certified that error appears in the above-identified patent and that said Letters Patent is hereby corrected as shown below:

Title page, Item [57], Abstract,
Line 3, please delete the word "attaches" and insert -- attached -- therefore.

Column 3,
Line 3, please delete "ofthe" and insert -- of the -- therefore.
Line 38, please delete "5" appearing after wear and before resistant.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*